US007285202B2

(12) United States Patent
Rumpf

(10) Patent No.: US 7,285,202 B2
(45) Date of Patent: Oct. 23, 2007

(54) METHOD FOR ELECTROPLATING A CYLINDRICAL INSIDE SURFACE OF A WORK-PIECE-EXTENDING SUBSTANTIALLY OVER A SEMI-CIRCLE

(75) Inventor: Thomas Rumpf, Gmunden (AT)

(73) Assignee: Miba Glietlager GmbH, Laakirchen (AT)

( * ) Notice: Subject to any disclaimer, the term of this patent is extended or adjusted under 35 U.S.C. 154(b) by 762 days.

(21) Appl. No.: 10/678,667

(22) Filed: Oct. 3, 2003

(65) Prior Publication Data

US 2004/0065556 A1 Apr. 8, 2004

(30) Foreign Application Priority Data

Oct. 4, 2002 (AT) ..... A 1502/2002

(51) Int. Cl.

| | |
|---|---|
| ***C25D 5/02*** | (2006.01) |
| ***C25D 5/08*** | (2006.01) |
| ***C25D 5/20*** | (2006.01) |
| ***C25D 7/00*** | (2006.01) |
| ***C25D 7/04*** | (2006.01) |

(52) U.S. Cl. ..... 205/131; 205/132; 205/133; 205/145; 205/148; 205/151

(58) Field of Classification Search ..... 205/131, 205/133, 134, 145, 148, 151, 132
See application file for complete search history.

(56) References Cited

U.S. PATENT DOCUMENTS

| | | | | |
|---|---|---|---|---|
| 2,761,831 | A * | 9/1956 | Luechauer | 204/297.1 |
| 2,944,947 | A | 7/1960 | Luechauer | 204/26 |
| 3,226,308 | A * | 12/1965 | Pochapsky et al. | 205/131 |
| 4,246,088 | A * | 1/1981 | Murphy et al. | 205/131 |
| 4,399,019 | A | 8/1983 | Kruper et al. | 204/212 |
| 5,364,523 | A | 11/1994 | Tadashi et al. | 205/128 |
| 5,372,700 | A * | 12/1994 | Pilorge et al. | 205/131 |
| 5,660,704 | A * | 8/1997 | Murase | 205/109 |
| 5,716,509 | A * | 2/1998 | Kamm | 205/99 |

* cited by examiner

*Primary Examiner*—Edna Wong
(74) *Attorney, Agent, or Firm*—Collard & Roe, P.C.

(57) ABSTRACT

A method is described for electroplating a cylindrical inside surface (4) of a work-piece (3) extending substantially over a semi-circle, with an electrolyte being conveyed from a bath (8) in a circulation through a gap (9) between the inside surface (4) and a revolving guide means (6). In order to ensure advantageous coating conditions it is proposed that the electrolyte is conveyed with the help of the guide means (6) immersed only partly in the bath (8) in the circumferential direction through the gap (9) between the guide means (6) and the work-piece (3) guided outside of the bath (8).

4 Claims, 4 Drawing Sheets

METHOD FOR ELECTROPLATING A CYLINDRICAL INSIDE SURFACE OF A WORK-PIECE-EXTENDING SUBSTANTIALLY OVER A SEMI-CIRCLE

FIELD OF THE INVENTION

The invention relates to a method for electroplating a cylindrical inside surface of a work-piece extending substantially over a semi-circle, with an electrolyte being conveyed from a bath in a circulation through a gap between the inside surface and a revolving guide means.

DESCRIPTION OF THE PRIOR ART

Since in electrodeposition the deposition speed depends among other things on the current density and the current density depends on the thickness of the boundary layer and the ion concentration prevailing in the same which can be influenced by a bath movement, the electrolyte can be guided in a forced flow along the work-piece surface to be coated in order to increase the deposition rate. For this purpose it is known in the coating of semi-cylindrical bearing elements (U.S. Pat. No. 4,399,019 A) to hold the semi-cylindrical bearing elements which are arranged axially successively one after the other in a frame which receives a cylindrical anode which is coaxial to the semi-cylindrical bearing elements and which is held so as to be drivable about its axis. The frame is immersed in an electrolytic bath with vertical axis and connected to a pump which conveys the electrolyte from the bath in a circulation through the gap between the bearing surface to be coated and the anode. This axial electrolyte flow is superimposed by a revolving flow through the rotational movement of the anode which forms a rotor provided with axial stirring rails, so that an advantageous forced flow of the electrolyte can be achieved at a relatively low output of the pump through the gap between the bearing surfaces to be coated and the anode. A comparatively high constructional complexity is still necessary. An additional factor is that not only is it necessary to wet the bearing surfaces to be coated with the electrolyte, but also the backs of the semi-cylindrical bearing elements, which necessitates special measures in order to avoid metal deposition outside of the bearing surfaces to be coated. Moreover, the complete wetting of the materials with the electrolyte during the removal of the work-pieces from the bath leads to an entrainment of the bath.

In order to avoid the disadvantages in connection with batch-wise coating of semi-cylindrical bearing elements, it has already been proposed (U.S. Pat. No. 2,944,947 A) to convey the semi-cylindrical plain bearing elements on horizontal slideways continuously through an eletrolytic bath, with the semi-cylindrical bearing elements which are disposed in an axially successive way rest with their axial face sides on the slideways. The difficulties in connection with the tight guidance of the semi-cylindrical bearing elements through the mutually opposite walls of a bath tank have led to the proposal (U.S. Pat. No. 5,364,523 A) to lower the individually delivered semi-cylindrical bearing elements step by step into a bath tank with the help of a vertical conveyor and to remove them from the bath tank again in the vertical direction after a horizontal shifting, thus leading to a considerable constructional complexity. Moreover, the difficulties in connection with the immersion treatment are still the same. The relative movement between the work-pieces and the electrolyte linked to the vertical conveyance of the work-pieces is insufficient, to achieve higher current densities.

SUMMARY OF THE INVENTION

The invention is thus based on the object or providing a method for electroplating a cylindrical inside surface of a work-piece extending substantially over a semi-circle, especially a semi-cylindrical plain bearing element, in such a way that the coating with high current densities can be limited to the cylindrical inside surface of the work-piece. Moreover, advantageous preconditions for a continuous treatment of the work-pieces are to be created.

Based on a method of the kind mentioned above, this object is achieved by the invention in such a way that the electrolyte is conveyed with the help of the guide means immersed only partly in the bath in the circumferential direction through the gap between the guide means and the work-piece guided outside of the bath.

As a result of these measures, the guide means which immerses only partly in the bath conveys the electrolyte from the bath through the gap between the guide means and the cylindrical inside surface of the work-piece to be coated. Through a respective adjustment of the radial distance between the guide means and the inside surface of the work-piece as well as the circumferential speed of the guide means it is managed with ease to ensure a laminar revolving flow of the electrolyte through the gap in order to thus allow an even metal deposition over the entire inside surface of the work-piece. Since the work-piece is arranged outside of the bath in this kind of wetting, the disadvantages in connection with the immersion of the work-piece in a bath can thus be avoided. Advantageous preconditions are created not only for an electrolytic flow limited to the inside surface of the work-piece to be coated, but also for a construction of low complexity because the work-pieces to be coated are coated above the bath level and can be displaced in the axial direction. This applies in particular when the inside surface of the work-piece to be coated is degreased, rinsed and activated in an analogous manner, such that the cleansing liquid, rinsing liquid and the pickling liquid are conveyed with the help of a rotor immersed partially in a respective bath through the gap formed between the rotor and the inside surface. For supporting the entrainment of the bath liquid, the rotors used for this purpose can be provided with a trimming of brushes or a porous intermediate layer receiving the treatment liquid. As a result of the work-piece treatment outside of the respective bathes there is a possibility to coat either individual work-pieces per se or work-pieces arranged successively on an axis in a continuous forward feed motion when the work-pieces are guided in a displaceable manner above the bath level in the direction of the axis of their cylindrical inside surfaces.

In order to provide an advantageous electrolyte flow through the gap between the inside surface of the work-piece to be coated and the guide means even in the case of larger radial distances between the guide means and the inside surface of the work-piece (which may become necessary in the case of deviations of the cylindrical inside surface from the circular shape), the guide means can be flowed against on the inlet side of the gap by the electrolyte in the direction of the gap, so that the flow against the guide means supports the introduction of the electrolyte into the gap.

In order to avoid having to cope with a deposition of the coating to be applied which differs over the circumference of the inside surface of the work-piece to be coated through a predetermined incoming and outgoing flow for the electrolyte, the circumferential direction of the guide means and thus the direction of conveyance for the electrolyte through the gap can be changed repeatedly during the deposition process.

For performing the coating method as described above, there can be a bath tank, a fixing device for the work-piece and a revolving guide means, between which and the inside surface of the work-piece there is a gap for conveying the electrolyte. It merely needs to be ensured that the guide means immerses only partly into the bath and is used as a conveyor for the electrolyte and that the fixing means receives the work-piece in a working position above the bath level. In order to enable the adjustment of the electrolyte flow through the gap between the inside surface of the work-piece and the guide means to the respective conditions, the revolving speed of the guide means can be adjustable. The radial flow against the guide means on the inlet side of the gap can be achieved advantageously by a nozzle facing the guide means, which nozzle is connected to a respective pump in order to convey the electrolyte with a respective pressure from the nozzle against the gap.

The fixing device for the work-piece can be formed by a sliding guide means for the work-piece in the direction towards the rotary axis of the rotor, thus providing simple constructional conditions. Such a sliding guide means is not mandatory because the only relevant aspect is that the work-pieces are held coaxially to the rotor for coating the inside surfaces.

In order to have an influence on the distribution of the electric field strength (which determines the deposition rate) over the axial extension of the inside surface to be coated and thus on the layer thickness distribution, the surface of the guide means which acts as anode can be provided with a profiling, so that different gap widths are obtained in an axial sectional view. In the region of smaller gap widths, the deposited layer will grow faster than in the region of larger gap widths due to the higher field strengths.

The coating of the cylindrical inside surface of the work-piece can occur in special cases in a reductive manner without external power supply. The usual electrolytic metal deposition by using an external current, for which the described method is especially suitable due to the achievable high current density is especially suitable, requires that the guide means is arranged as an electrode. If the guide means forms a soluble anode, then a growing gap width must be expected. In order to avoid such an increase in the distance between the inside surface of the work-piece to be coated and the guide means, the guide means can consist of an insoluble anode. Especially advantageous conditions are obtained however when for this purpose the guide means is arranged as a bipolar electrode between the work-piece switched as a cathode and an anode arranged in the bath. In the case of such a bipolar electrode the guide means acts on the side averted from the work-piece as a cathode, so that the coating metal will deposit in this region on the guide means which is dissolved again in the region of the cathode formed by the work-piece because in this region the guide means acts as an anode due to the charge transfer. A balance can thus set in between the metal deposition on the guide means and the dissolving of the deposited metal, so that constant deposition conditions can be expected over long service periods.

To ensure that the thickness of the coating can be chosen differently not only in the axial direction but also in the circumferential direction according to the respective requirements, the guide means can be provided with an arrangement so as to be displaceable in the radial direction relative to the fixing means for the work-piece, thus leading to a changing gap width in the circumferential direction and thus a different deposition rate.

The guide means per se can be provided with a differing arrangement. Especially simple constructional conditions are obtained when the guide means consists of a rotor parallel to the axis of the inside surface of the work-piece. The guide means can also comprise a circular support for an electrolyte-permeable intermediate layer which fills the gap at least partly in order to promote the conveyance of the electrolyte via said intermediate layer. The intermediate layer can also be used for improving the deposition conditions when the surface of the intermediate layer rests on the inside surface of the work-piece. The sliding friction between the surface of the intermediate layer and the inside surface of the work-piece surprisingly improves the deposition conditions. This fact can also be used for profiling the layer to be deposited. This can occur for example in such a way that a fabric is used as the surface of the intermediate layer which forms thick points in the region of the crossing points between weft and warp, in the region of which there is a contact between the inside surface of the work-piece or the growing coating, with the deposition rate for the coating being increased in the contact zone.

Another possibility for forming the intermediate layer is obtained by using a brush trimming for the intermediate layer. Said brush trimming can be used for the surface arrangement of the deposited layer in addition to supporting the conveyance of the electrolyte. If the electrically conductive bristles of the brush trimming end at a radial distance from the inside surface of the work-piece, said bristles form a respectively structured anode with a higher field strength in the region of the bristles which leads to a higher deposition rate in the bristle region when the bristles form lines extending in the circumferential directions. The bristles of the brush trimming can also rest on the inside surface of the work-piece in order to utilize the frictional effect for increased deposition. In this case the bristles of the brush trimming need to consist of an electrically insulating material.

Finally, the electrolyte can be conveyed through radial pass-through openings of the guide means in the gap between the guide means and the inside surface of the work-piece. The circulatory movement of the guide means needs to be maintained in order to prevent flow-induced irregularities in electroplating.

BRIEF DESCRIPTION OF THE DRAWINGS

The method in accordance with the invention is now explained in closer detail by reference to the enclosed drawings, wherein.

DESCRIPTION OF THE PREFERRED EMBODIMENTS

Figure 1:
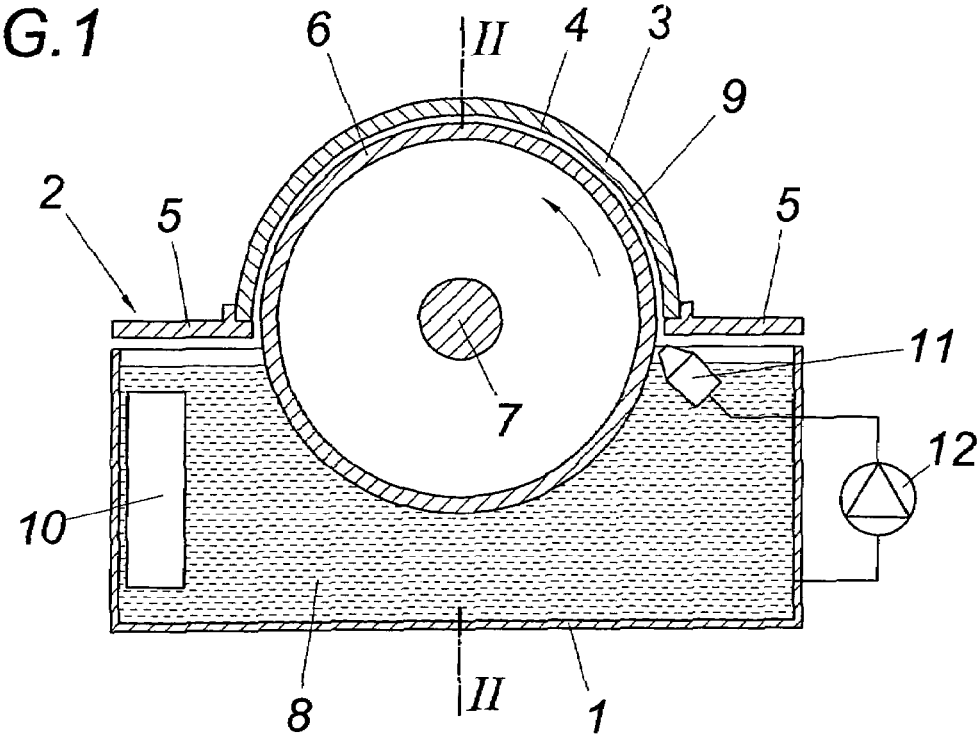
FIG. 1 shows an apparatus in accordance with the invention for electroplating a cylindrical inside surface of a work-piece in a sectional view normal to the axis.

According to FIG. 1, the illustrated apparatus comprises a bath tank 1 above which a fixing device 2 for a work-piece 3 is provided, comprising a cylindrical inside surface 4 which is to be electroplated and comes in the cross-sectional shape of a semi-circle, as is shown for example by semi-cylindrical bearing elements. Fixing device 2 consists of a sliding guide means 5 with two slideways on which the axial face surfaces of the work-piece 3 are supported. A guide means 6 in the form of a rotor is provided coaxially to the inside surface 4 of the work-piece 3, which rotor is driven in a speed-controlled manner via shaft 7. Said guide means 6 partly immerses in an electrolytic bath 8 in order to convey the electrolyte from the bath 8 in a circulatory flow through the gap 9 which is obtained between the guide means 6 and the inside surface 4 of work-piece 3. By choosing the size of the gap 9 and the circulation speed of the guide means 6 it is possible in an advantageous manner to maintain a laminary flow of the electrolyte through the gap 9 by which a metal layer is electroplated on the inside surface 4. For this purpose the work-piece 3 is connected as a cathode to a voltage source which is connected to an anode 10 arranged in the bath 8. The guide means 6 thus forms a bipolar electrode which as a result of the charge transfer in the electrical field between the cathode formed by the work-piece 3 and the anode 10 acts in the circumferential region facing the work-piece 3 as an anode, but acts as a cathode in the opposite circumferential region. This means that metal is electroplated on the circumferential region of the guide means 6 which is averted from the work-piece 3 which is dissolved again in the region of gap 9, so that constant conditions with respect to diameter are obtained.

In order to support the flow of electrolyte through the gap 9, a nozzle 11 is provided on the inlet side of gap 9, which nozzle is connected to a pump 12 so that electrolyte is conveyed from the bath tank 1 to the nozzle 11 in order to allow electrolyte to flow against the guide means 6 in the direction towards the gap 9, thus supporting the laminar flow of electrolyte through the gap 9, especially in the case of larger gap widths. As a result of the speed of the electrolyte flow produced by the circulation of guide means 6 along the inside surface 4 to be coated, a comparatively high current density can be achieved, leading to high rate of deposition. The conveyance of the electrolyte from the bath 8 along the inside surface 4 to be coated of the work-piece 3 arranged outside of the bath 8 in a circulation back into the bath 8 also ensures a wetting of the work-piece 3 with the electrolyte of the bath 8 which is limited to the inside surface 4 to be coated, as a result of which the disadvantages in connection with the immersion of the work-piece 3 into the bath 8 are avoided concerning the complete wetting of the work-piece 3 and the thus dependent bath entrainment.

Figure 2:
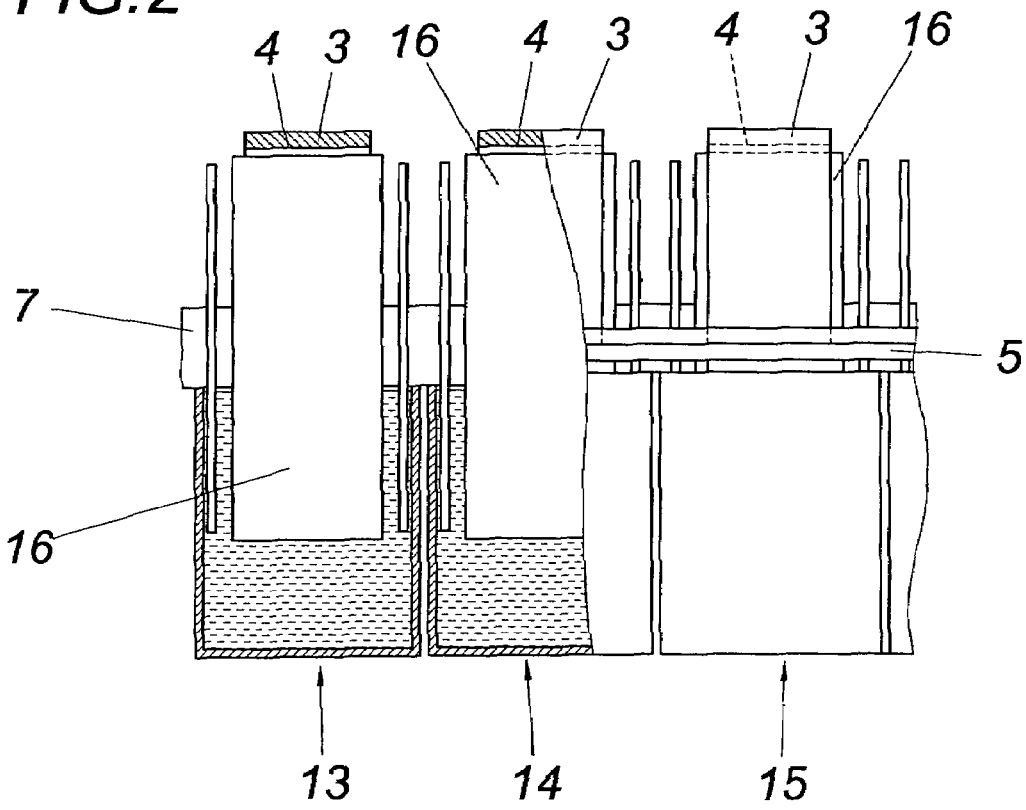
FIG. 2 shows this apparatus in a partly sectional side view.

As is shown in FIG. 2, the sliding guide means 5 offers a simple possibility to supply a work-piece 3 successively to individual treatment stages in order to grease, rinse or pickle the work-piece before metal in a single or multiple layers is deposited on the inside surface 4. When rotors 16 are each arranged in analogy to the guide means 6 of the electrolytic bath 8 in the individual treatment stages 13, 14 and 15, the respective bath liquids can be applied in the same manner by the rotors 16 onto the inside surface 4 of the work-piece 3 in order to subject the inside surface 4 to be coated with the respective treatment by the bath liquid. The displacement of the work-pieces 3 from treatment stage to treatment stage occurs by simple axial displacement along the sliding guide means 5 which extends over all treatment stations. It is understood that with such a work-piece guiding system it is possible to continuously treat not only individual work-pieces 3 per se but also axially successively arranged work-pieces.

An electrically conductive semi-circular bearing element which consists of a steel supporting shell and a bearing material on the basis of leaded bronze applied to the supporting shell was provided with a running layer made of lead, tin and copper with the help of the described apparatus. The semi-cylindrical bearing element was degreased with a commercially available alkaline cleansing liquid, rinsed with water and then pickled with a mixture of hydrochloric acid and iron chloride. A rotor with an inside diameter of 150 mm was used for an inside diameter of the semi-cylindrical bearing element of 155 mm. The rotor was driven with 540 r.p.m. The pickling time was 40 seconds. The inside surface of the semi-cylindrical bearing element which was activated in this manner was rinsed after an axial displacement to a rinsing bath during a period of 40 seconds. Similar dimensions and drive conditions were obtained for the rotor because the rotors of all treatment stages were driven via a common shaft and all had the same diameter.

A nickel layer with a thickness of 2 μm as a diffusion block was electroplated after the rinsing onto the inside surface from a conventional nickel electrolyte. The rotor forming the guide means was used in this process as a bipolar electrode. As a result of the electrolyte flow formed through the gap arising between the guide means and the semi-cylindrical bearing element, a current density of 75 $A/dm^2$ was achieved, limiting the coating time to 8 seconds. After the application of the nickel layer and an additional rinsing, a conventional running layer made of a lead-copper-tin alloy was deposited with a thickness of 20 μm, namely at a current density of 60 $A/dm^2$ and a coating time of 40 seconds which could only be achieved by the electrolyte flow in accordance with the invention through the gap between the guide means and the semi-cylindrical bearing element. An electrolyte on the usual basis of lead, tin and copper fluoroborates was used. Finally, a running surface cover layer with a thickness of 2 μm was deposited after the rinsing from an electrolyte with tin fluoroborate. A current density of 40 $A/dm^2$ was used for 6 seconds.

Figure 3:
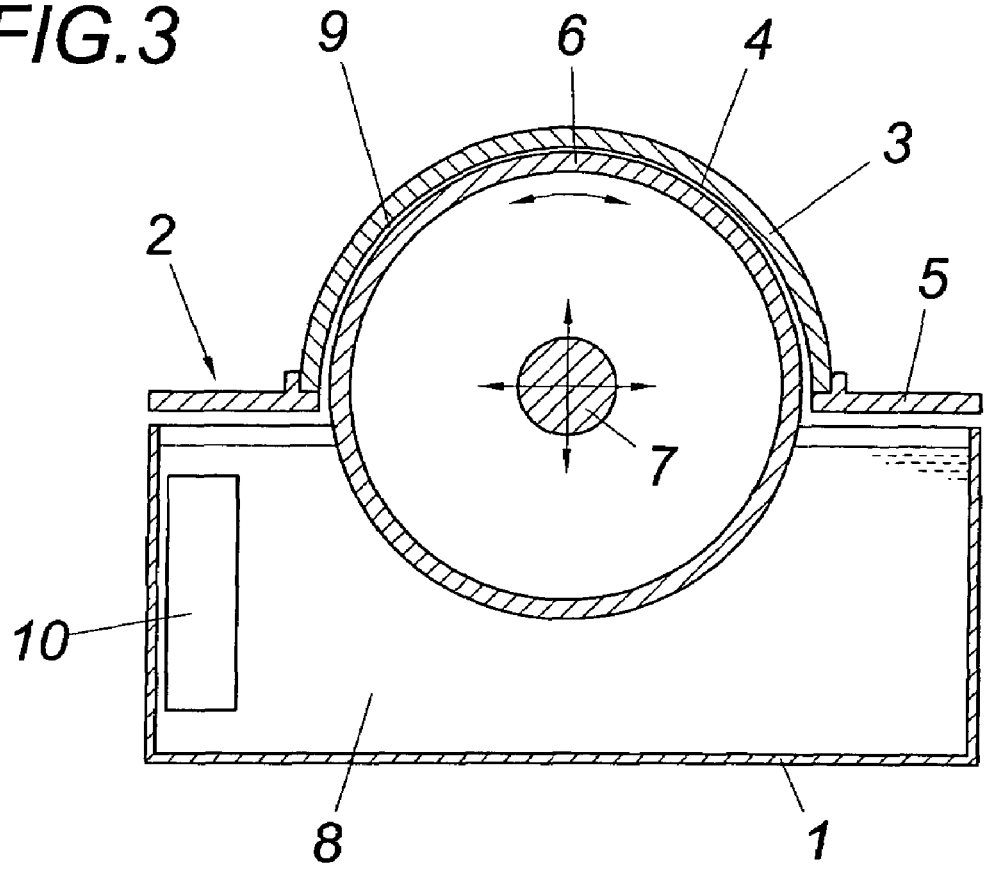
FIG. 3 shows a representation according to FIG. 1 of a constructional variant.

As is shown in FIG. 3, the guide means 6 can be displaced radially from a coaxial starting position relative to the fixing device 2 and thus relative to the inside surface 4 of the work-piece 3, thus leading to different widths of the gap 9 between the guide means 6 and the inside surface 4 of the work-piece 3. As a result of the changing gap width, the respective alloy is deposited with a thickness on the inside surface 4 which changes over the circumference.

Figure 4:
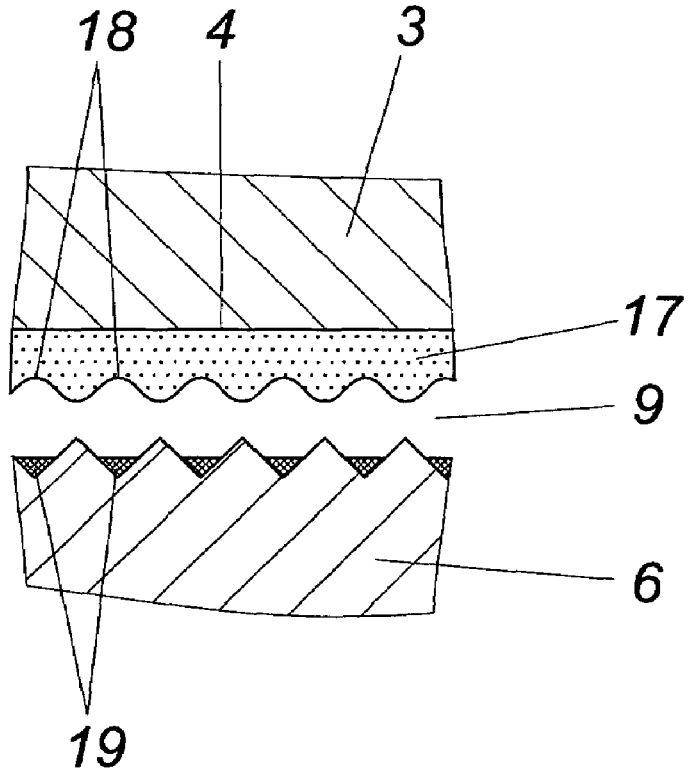
FIG. 4 shows a guide means which is profiled in the surface area in an axial sectional view on an enlarged scale.

In order to ensure that the coating 17 of the inside surface 4 of the work-piece 3 can be profiled in the axial direction, the anode surface is profiled in a respective manner in accordance with FIG. 4, which anode surface is formed by the guide means 6 and is opposite of the inside surface 4 to be coated. The circumferential ribs provided for in the illustrated embodiment produce a higher rate of deposition in their region for the coating 17, which is thus subjected to a profiling in the form of groove-like recesses 18 which extend in the circumferential direction. In order to amplify the difference between the electrical field strength which is responsible for the different rate of deposition, electric insulations 19 can be provided between the circumferential ribs of the guide means 6.

Figure 5:
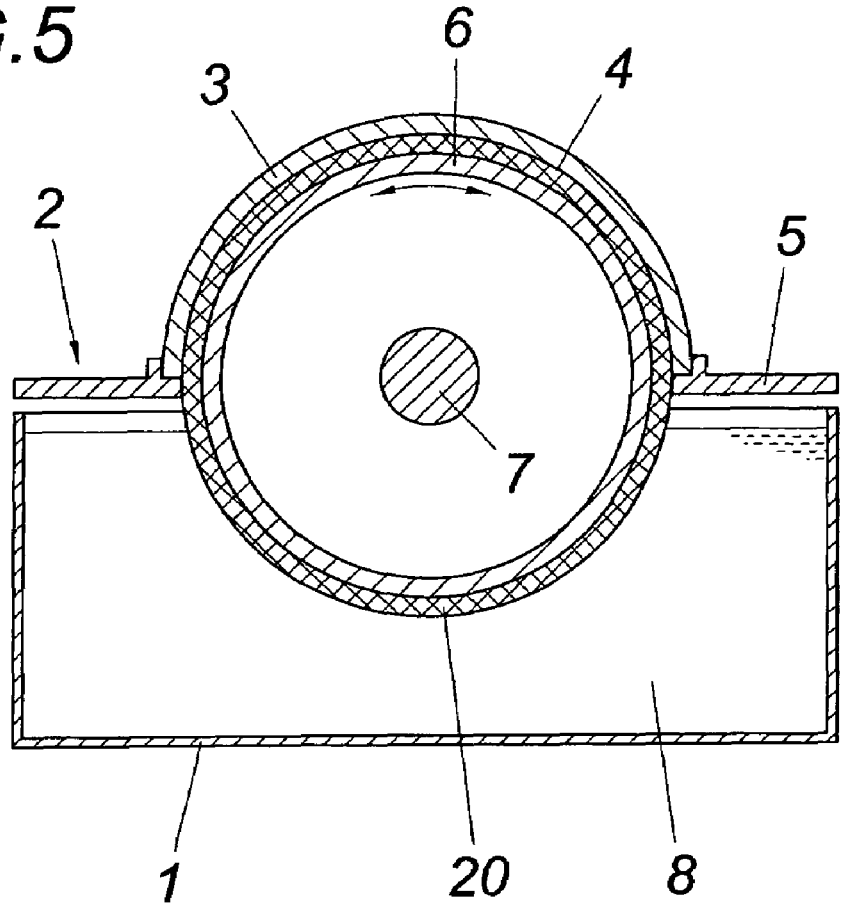
FIG. 5 shows a further embodiment of an apparatus in accordance with the invention in a schematic sectional view normal to the axis.
Figure 6:
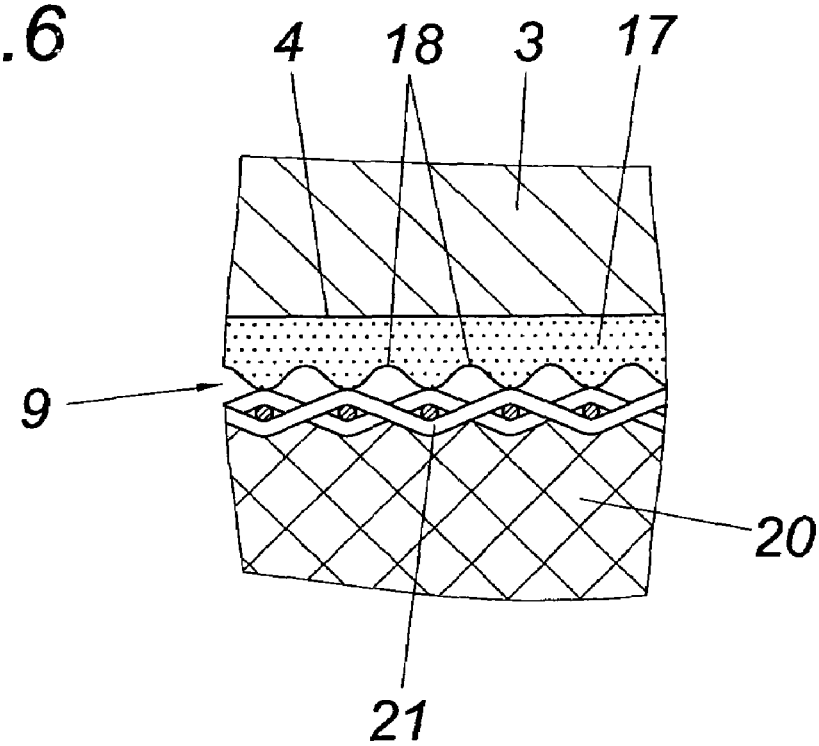
FIG. 6 shows a representation corresponding to FIG. 4 of a constructional variant of a profiled surface of the guide means.

For the purpose of supporting the conveyance of the electrolyte, the guide means 6 is provided with an intermediate layer 20 according to FIG. 5, which layer is provided with a porous arrangement and consists of a non-woven material for example through which the electrolyte is supplied to the inside surface 4 of the work-piece 3. In accordance with FIG. 6, said intermediate layer 20 can be covered with a fabric 21 which in the region of the crossing points of weft and warp comprises enlargements which rest on the inside surface 4 or on the growing coating 17 and ensure a more rapid growth of the coating, which leads to the consequence that again groove-like recesses 18 are produced in the surface of the coating 17 when it is ensured that the thick points of the fabric 21 are aligned in the circumferential direction of the guide means 6.

Figure 7:
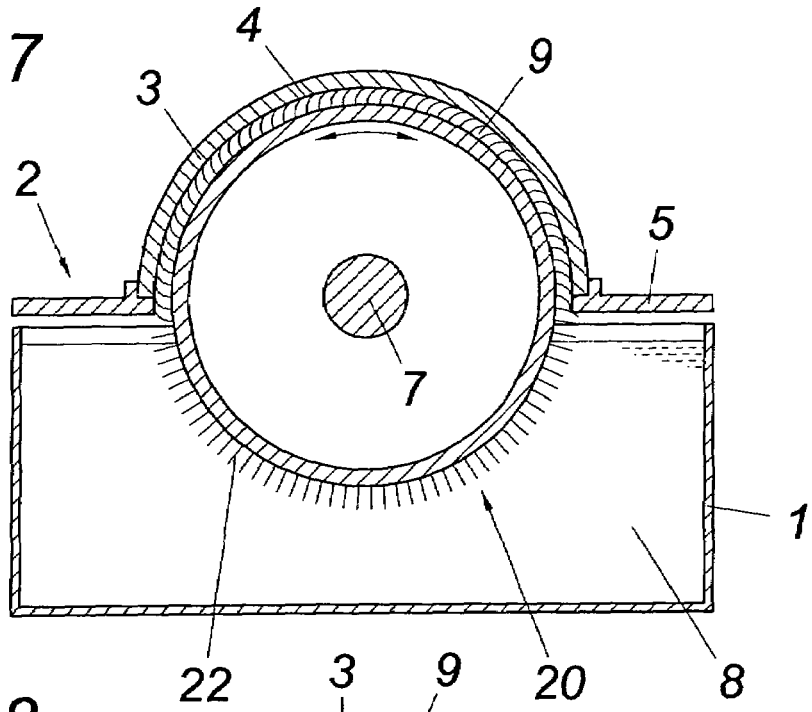
FIG. 7 shows a further embodiment of an apparatus in accordance with the invention in a schematic sectional view normal to the axis.
Figure 8:
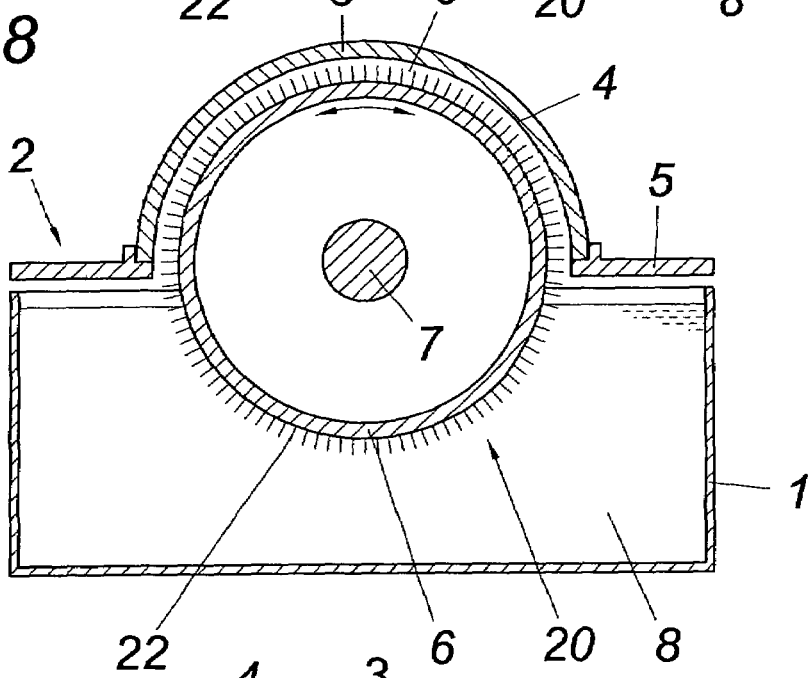
FIG. 8 shows a representation corresponding to FIG. 7 of a further constructional variant.

As is shown in FIGS. 7 and 8, the intermediate layer 20 can also consist of a brush trimming 22. Whereas the brush trimming 22 according to FIG. 7 consists of electrically non-conductive bristles which rest on the inside surface 4 of the work-piece 3, the bristles of the brush trimming 22 according to FIG. 8 consist of an electrically conductive material, with the bristles ending at a radial distance from the inside surface 4. As a result, the brush trimming 22 according to FIG. 7 leads to a more rapid layer growth in the contact region due to the contact of the bristles. The electrically conductive bristles according to FIG. 8 lead in their region to higher field strengths. Although this also leads to a profiling of the coating, this is due to a different effect however.

Figure 9:
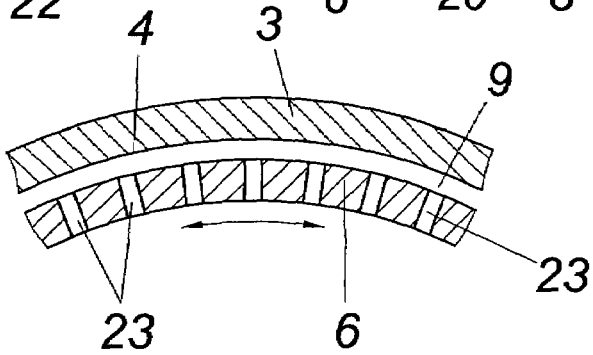
FIG. 9 shows the gap between the guide means and the inside surface of a work-piece in a sectional view normal to the axis on an enlarged scale.

It is finally indicated in FIG. 9 that the electrolyte can also be guided by the guide means 6 into the gap 9 between the guide means 6 of the inside surface 4 of the work-piece 3 to the inside surface 4 of the work-piece when the guide means 6 is provided with respective pass-through openings 23 which are connected to a respective feed line for the electrolyte. The circulation of the guide means 6 must be maintained in order to prevent flow-induced irregularities concerning the depositing.

The invention claimed is:

1. A method for electroplating a cylindrical inside surface of a work-piece extending substantially over a semi-circle by conveying an electrolyte from a bath in a circulation through a gap between the inside surface and a revolving guide means, the method comprising the step of:

conveying the electrolyte outside of the bath in a circumferential direction through the gap between the guide means and the inside surface with the help of the guide means immersed only partly in the bath; and electroplating the cylindrical inside surface of the work-piece.

2. A method according to claim 1, wherein on an inlet side of the gap the electrolyte flows against the guide means in a direction of the gap.

3. A method according to claim 1, further comprising the step of repeatedly changing a revolving direction of the guide means and thus the conveying direction for the electrolyte through the gap.

4. A method according to claim 1, wherein the work-piece is held in a displaceable manner above the bath level in the direction of the axis of its cylindrical inside surface.

* * * * *

UNITED STATES PATENT AND TRADEMARK OFFICE

CERTIFICATE OF CORRECTION

PATENT NO. : 7,285,202 B2
APPLICATION NO. : 10/678667
DATED : October 23, 2007
INVENTOR(S) : Rumpf It is certified that error appears in the above-identified patent and that said Letters Patent is hereby corrected as shown below:

In particular, in Column 8, line 19, (Line 5 of Claim 1), please change "step" to correctly read: --steps--.

Signed and Sealed this

Twenty-fifth Day of December, 2007

JON W. DUDAS
*Director of the United States Patent and Trademark Office*